US005820473A

United States Patent [19]

Lambros

[11] Patent Number: 5,820,473

[45] Date of Patent: Oct. 13, 1998

[54] BILLARD CUE WITH IMPROVED JOINTS FOR GREATER STABILITY

[76] Inventor: Michael Lambros, 235 S. Clinton St., Baltimore, Md. 21224-2343

[21] Appl. No.: 637,847

[22] Filed: Apr. 25, 1996

[51] Int. Cl.[6] ..... A63D 15/08

[52] U.S. Cl. ..... 473/44

[58] Field of Search ..... 473/44, 46, 47; 43/18.1; 285/23, 341, 315, 38, 87; 277/622

[56] References Cited

U.S. PATENT DOCUMENTS

| | | | |
|---|---|---|---|
| D. 320,058 | 9/1991 | Reves . | |
| D. 361,111 | 8/1995 | Janes . | |
| D. 361,361 | 8/1995 | Janes . | |
| 970,172 | 2/1910 | Bloom et al. . | |
| 1,020,018 | 3/1912 | Bonin | 473/44 |
| 1,116,827 | 11/1914 | Lee et al. . | |
| 1,280,876 | 10/1918 | Seenan | 473/44 |
| 1,527,748 | 8/1925 | Rambow . | |
| 2,257,326 | 12/1941 | Blum . | |
| 3,232,613 | 2/1966 | Laube | 473/47 |
| 3,436,079 | 4/1969 | Berry | 473/44 |
| 3,462,147 | 8/1969 | Mancuso | 473/44 |
| 4,943,333 | 7/1990 | Chang . | |
| 4,949,965 | 8/1990 | Ross, Jr. et al. . | |
| 5,290,030 | 3/1994 | Medbury . | |
| 5,334,101 | 8/1994 | McDermott . | |
| 5,514,039 | 5/1996 | Gendron | 473/44 |
| 5,527,224 | 6/1996 | Costain | 473/44 |

FOREIGN PATENT DOCUMENTS

| | | | |
|---|---|---|---|
| 2246302 | 1/1992 | United Kingdom | 473/44 |

*Primary Examiner*—Theatrice Brown
*Attorney, Agent, or Firm*—Law Offices Of Royal W. Craig

[57] ABSTRACT

An improved main joint and/or A joint for a billiard cue stick of the type having at least two detachable sections. The joints include mating tenons extending from opposing sections of the cue stick, and a threaded screw anchored in one of the two sections and extending axially outward through the respective tenon for screw insertion into the mating tenon of the second section. A single or dual-ring collar is also provided for encircling the mating tenons of the two sections. The collar encircles the tenons when the two sections are fully screwed together, and confines the tenons as the screw force causes them to expand. Both the A joint and main joint give an improved self-aligning compression fit. A billiard cue incorporating one or both of said joints will have an increased level of structural integrity in order to reduce deflection and resonance when the billiard cue strikes a cue ball. This helps to give the feel of a solid one-piece cue stick and increases the accuracy and life expectancy thereof.

20 Claims, 5 Drawing Sheets

BILLARD CUE WITH IMPROVED JOINTS FOR GREATER STABILITY

BACKGROUND OF THE INVENTION

1. Field of the Invention

The present invention relates to billiard cues and, more particularly, to a detachable-sectional billiard cue and improved joints for increasing the level of control available to the player.

2. Description of the Background

The billiard cue has evolved from a simple wooden stick into precision-machined cue that is typically detachable into two or three parts. This facilitates portability of the cue, which otherwise may extend to over five feet in length. For instance, U.S. Pat. No. 970,172, issued to Bloom et al. in 1910, is an early two-piece cue stick which allows the cue to be separated into butt and shaft sections when not in use. The joint illustrated in the '172 patent has come to be known as the main joint.

U.S. Pat. No. 1,527,748, issued to Rambow in 1925 added an additional joint designed to permit adjustable and more centralized weighting and balancing of cue stick. This second joint was a significant improvement and has been widely accepted. It is commonly known as the A joint.

Subsequent patents such as U.S. Pat. Nos. 3,232,613 to Laube, 3,462,147, 3,368,271, and 3,436,079 have refined the screw-threaded connecting joint for billiard cues.

These prior art joints permit rapid attachment and detachment of the cue sections, e.g., shaft section to forearm section via the main joint. However, they lack sufficient lateral and/or radial stability between mating sections. The lack of stability at the joint(s) sacrifices structural integrity. Specifically, whenever a cue ball is struck off center, radial forces are transmitted back into the cue stick. This causes deflection of the cue stick on contact, and subsequent resonance along the length of the cue stick. The lack of lateral and/or radial stability at the joints amplifies the deflection and resonance of the cue stick. With two such joints, deflection and resonance are quite significant and the advanced player loses his precise "feel" as compared to an integrally formed, single-piece cue. This reduces the level of control available to the player, and his game suffers considerably.

It would be greatly advantageous to improve both the main joint and A joint of a billiard cue in order to provide a cue stick with a higher level of structural integrity, e.g., a level of optimum stability to ensure the consistent hit and feel of the cue regardless of where or how hard the cue ball is struck. Even if struck off center, there should be minimal deflection of the cue on contact and resonance should be dampened. This would serve to give the feel of a solid one-piece cue stick and increase the accuracy and life expectancy thereof.

SUMMARY OF THE INVENTION

In accordance with the above, it is an object of the present invention to provide a simple, inexpensive and efficient main joint and A joint for a billiard cue or the like, which joints increase the level of structural integrity in order to improve both lateral and radial stability and thereby dampen vibration as the cue stick strikes a billiard ball.

It is another object of the invention is to provide a self-aligning and positive locking joint between the sections of a cue stick to give the feel of a solid one-piece cue stick and increase the accuracy and life expectancy thereof.

It is another object to provide a jointed billiard cue incorporating one or both joints as described above which, when joined together, provide a billiard player with the feel and improved control of a single-piece cue.

According to the present invention, the above-described and other objects are accomplished by providing improved joint designs for the A joint and main joint of a billiard cue stick of the type having at least two detachable sections. In general terms, the improved joint design includes a first tenon extending from a mating end of one of the sections, and a second tenon extending from a mating end of the other cue stick section. The second tenon is provided with a receptacle at its tip, and the first tenon is provided with convex tip adapted to be captured by the receptacle of the second tenon. A threaded screw anchors the two sections and is screwed into one of the two sections where it extends longitudinally outward through the respective tenon for screw insertion into the mating tenon of the second section. A collar is also provided for encircling the mating tenons of the two sections. The collar encircles and confines the tenons when the two sections are fully screwed together and the screw force causes the mating tenons to expand.

A more detailed design for a main joint is disclosed in which the first tenon is formed with a section of convex (e.g., conical) periphery. The second tenon is formed with a concave receptacle at its tip adapted for receiving the convex section of the first tenon. Both sections have a pre-drilled hole entering axially through the tenons and into the respective shaft sections for insertion of the threaded screw. The pre-drilled hole in the second tenon is formed with an initially greater diameter leading to a reduced diameter approximately midway through the second tenon. The initially greater diameter is slightly greater than that of the threaded screw in order to leave a clearance. The clearance accommodates the cylindrical tip of the first tenon. The reduced diameter hole conforms to and anchors the screw. The screw anchors the two sections and is screwed into one of the two sections where it extends longitudinally outward through the respective tenon for screw insertion into the mating tenon of the second section. A dual-ring collar encircles the mating tenons of the two sections. The dual-ring collar includes a first ring defined by a cylindrical interior surface leading to an enlarged receptacle at one end, and a second ring having a partially cylindrical periphery leading to a conical tip for insertion and self-aligned seating in the receptacle of the first cylindrical ring. The dual-ring collar confines the tenons when the two sections are fully screwed together and when the screw force causes the mating tenons to expand.

An improved design for an A joint is also disclosed in which the first tenon is formed with a cylindrical base protruding to a constricted convex (e.g. conical) section, in turn leading to a cylindrical tip of reduced diameter relative to the cylindrical base. The second tenon is formed with a central receptacle for capturing the cylindrical tip of the first tenon. Both sections have a pre-drilled hole entering axially through the tenons and into the respective shaft sections for insertion of the threaded screw. The screw is anchored in one of the two sections and extends axially outward through the respective tenon for screw insertion into the mating tenon of the second section. Again, the pre-drilled hole in the second tenon is formed with an initially greater diameter leading to a reduced diameter approximately midway through the second tenon. The initially greater diameter is slightly greater than that of the threaded screw in order to leave a clearance. The clearance accommodates the cylindrical tip of the first tenon. The reduced diameter hole conforms to and anchors the screw. A single-ring collar is also provided for encircling the mating tenons of the two sections. The collar encircles and confines the tenons when the two sections are fully screwed together and the screw force causes the mating tenons to expand.

It is intended that the invention encompass the self-aligning structure of the A joint as well as the main joint, as well as a billiard cue incorporating one or both of said joints. Both the A joint and main joint increase the level of structural integrity. They give an improved self-aligning compression fit with enhanced lateral and radial stability to ensure the consistent hit and feel of the cue. This is true regardless of where or how hard the cue ball is struck. Even if struck off center, there is minimal deflection of the cue on contact and resonance is dampened. This helps to give the feel of a solid one-piece cue stick and increases the accuracy and life expectancy thereof.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

Figure 1:
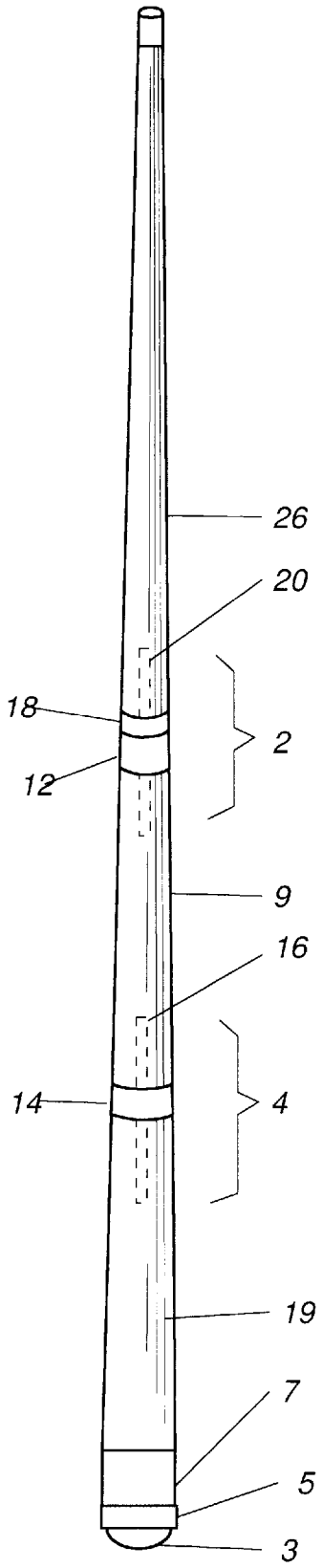
FIG. 1 is a front perspective view of an exemplary three-piece cue stick incorporating both a main joint 2 and A joint 4 according to one embodiment of the present invention.

FIG. 1 is a front perspective view of a three-piece cue stick incorporating both a main joint 2 and A joint 4 according to one embodiment of the present invention. It should be noted that the cue stick of FIG. 1 is exemplary. The present invention is intended to encompass the joint structures in and of themselves, whether incorporated singly or in combination in a two or three piece billiard cue stick.

As seen in the context of FIG. 1, the exemplary cue stick includes three sections, e.g., the forearm section 9 extending between main joint 2 and A joint 4, the shaft section 26 extending above main joint 2, and the butt section 19 extending below A joint 4. When not in use, the cue stick may be easily separated at the main joint 2 for transportation and storage. The sections are anchored by threaded internal screws 16, 20. The A joint 4 is designed to permit adjustable and more centralized weighting and balancing of cue sticks, and the proper balance can be achieved by sizing/positioning/adjusting threaded internal screw 16 at the manufacturer.

As in conventional cue sticks, the butt section 19 may include a bumper 3, butt cap 5, and butt sleeve 7.

The improved A joint 4 includes a single-ring joint collar 14 formed of phenolic, plastic, metal or other suitable material. Joint collar 14 imposes a compression fit and improves the aesthetic appearance of the main joint 4. A joint 4 also includes an internal threaded screw 16 for anchoring the butt section 19 to the forearm 9, and for balancing the cue stick. Forearm 9 extends upwardly from A joint 4 to the main joint 2.

Figure 2:
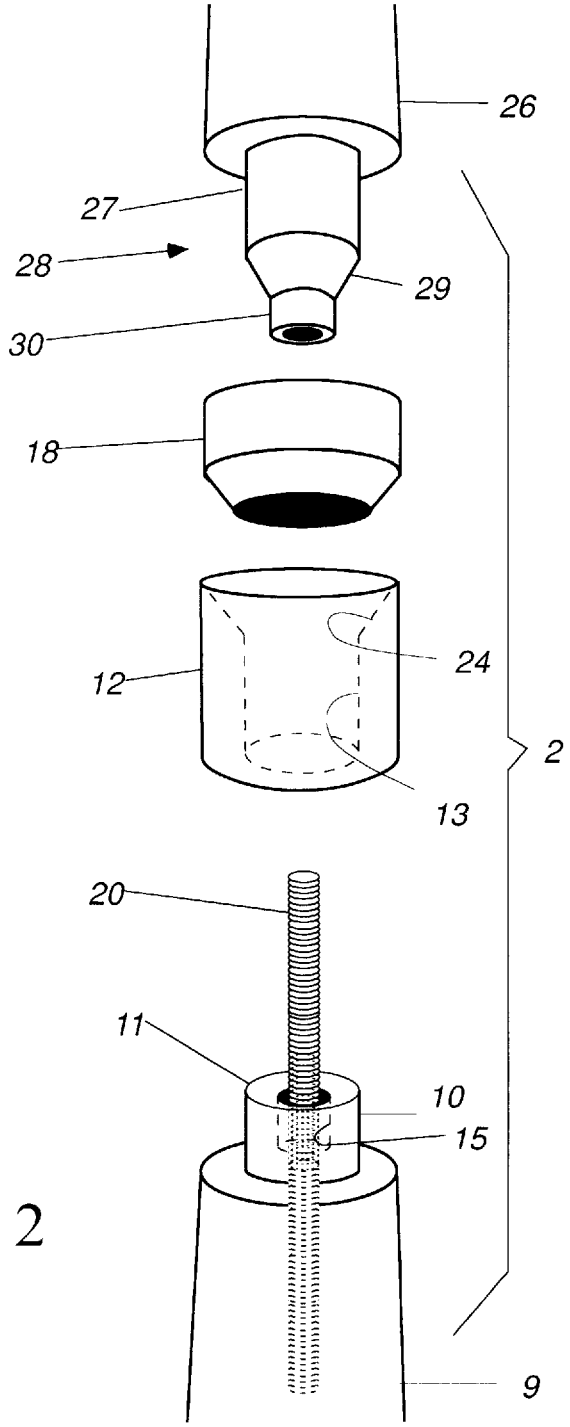
FIG. 2 is a break-away perspective drawing of a main joint 2 as shown in FIG. 1.

The improved main joint includes a dual-ring joint collar 12, 18 and internal threaded screw 20 as shown more clearly in FIG. 2.

FIG. 2 is a break-away perspective drawing of the main joint 2 as shown in FIG. 1. The dual-ring joint collar includes a first joint collar 12 defined by a cylindrical interior surface 13 leading to an enlarged concave receptacle 24 at one end. The dual-ring joint collar also includes a second joint collar 18 having a partially cylindrical periphery leading to a convex (e.g., conical) tip for insertion and self-aligned seating in the receptacle 24 of the first joint collar 12.

Forearm 9 extends upwardly to a reduced diameter forearm tenon 10. The diameter of forearm tenon 10 corresponds to the cylindrical interior surface 13 of first joint collar 12, and first joint collar 12 is adapted for slidable insertion onto forearm tenon 10. Upon full insertion the forearm tenon 10 should extend upwardly to the beginning of the flared upper receptacle 24 inside main joint collar 12. The forearm tenon 10 is provided with a concave (for instance, conically recessed) tip 11 with a pre-drilled central hole for insertion of a threaded internal screw 20. The pre-drilled hole in the forearm tenon 10 is formed with an initially greater diameter leading to a reduced diameter approximately midway through the forearm tenon 10. The initially greater diameter is slightly greater than that of the threaded screw 20 in order to leave a clearance. The clearance accommodates the cylindrical tip 30 of the shaft tenon 28. Below this, the reduced diameter hole conforms to and anchors the screw 20. Threaded internal screw 20 is screwed downwardly into the pre-drilled hole through the forearm tenon 10 and is anchored in the forearm 9. When securely anchored in forearm 9, the threaded internal screw 20 should extend upwardly through and past main joint collar 12 for threaded insertion into upper shaft 26.

The shaft 26 is likewise formed with a downwardly protruding shaft tenon 28 having an axial internally-threaded through-bore for receiving threaded internal screw 20. Shaft tenon 28 begins with a cylindrical base 27 protruding to a convex (e.g., conical) section 29, in turn leading to a cylindrical tip 30 of reduced diameter relative to the cylindrical base 27. The cylindrical base 27 is sized for slidable insertion through the dual-rings 12, 18 of the joint collar. The conical surface of convex section 29 is adapted for seating within the concave receptacle 11 at the tip of forearm tenon 10, and the smaller cylindrical tip 30 of the shaft tenon is sized for insertion into the clearance 15 in forearm tenon 10 around threaded internal screw 20.

For assembly, the first joint collar 12 is inserted over the reduced diameter forearm tenon 10 and is captured thereby on forearm 9. Second joint collar 18 is then seated on the first joint collar 12 with its convex tip guiding it into the mating first joint collar 12. The dual-ring 12, 18 presents a uniform diameter cylindrical interior channel for the tenons. Shaft tenon 28 is inserted through the second joint collar 18 until the threaded internal screw 20 enters the pre-drilled (threaded) hole of shaft tenon 28. Forearm 9 is then rotated with respect to upper shaft 26 in order to screw the threaded internal screw 20 into the pre-drilled (threaded) hole of shaft tenon 28. Screw insertion continues until the constricted tip 30 of shaft tenon 28 becomes seated in the concave tip 11 of forearm tenon 10. The dual-ring collar 12, 18 confines the two tenons when the two sections are fully screwed together (at which point the screw force causes the mating tenons to expand).

Figure 3:
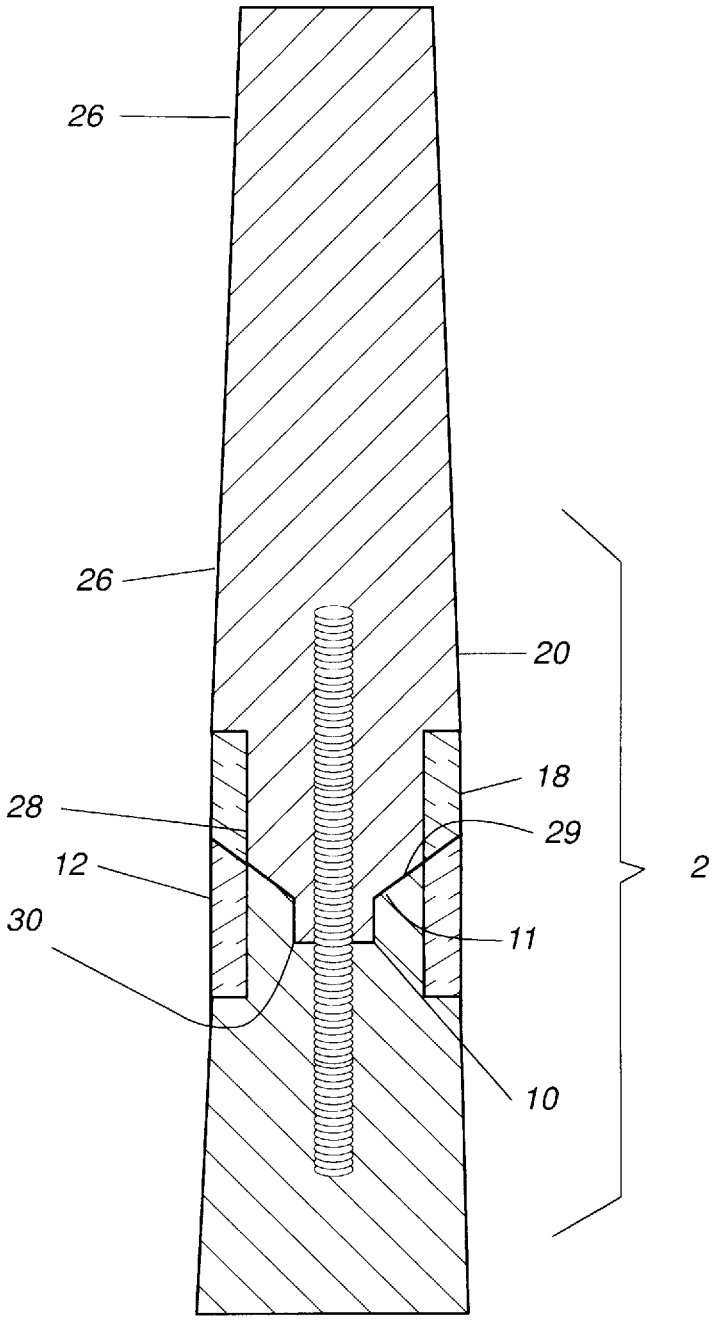
FIG. 3 is a front sectional drawing of the main joint 2 as shown in FIGS. 1 and 2.

FIG. 3 is a front sectional drawing of the fully assembled main joint 2 as shown in FIGS. 1 and 2. As the main joint 2 is tightened in the above-described manner, the downward pressure of the constricted tip 30 of shaft tenon 28 against the recessed concave receptacle 11 of forearm tenon 10 serves to perfectly align the shaft 26 with forearm 9. Likewise, the pressure aligns the first joint collar 12 (via its enlarged conical receptacle) with the mating second joint collar 18. Compression is exerted by the dual-ring joint collar 12, 18 on the juncture of the shaft tenon 28 and forearm tenon 10. This greatly increases the integrity of the main joint 2. Adhesive may be used as desired during fabrication. The main joint 2 provides a level of optimum stability to ensure the consistent hit and feel of the cue regardless of where or how hard the cue ball is struck. Even if the cue ball is struck off center, there is less deflection of the cue at the joint, and resonance is dampened. This gives the feel of a solid one-piece cue stick and increases the accuracy and life expectancy thereof. The advanced player gains the precise "feel" of an integrally formed, single-piece cue, and this increases the level of control.

Figure 4:
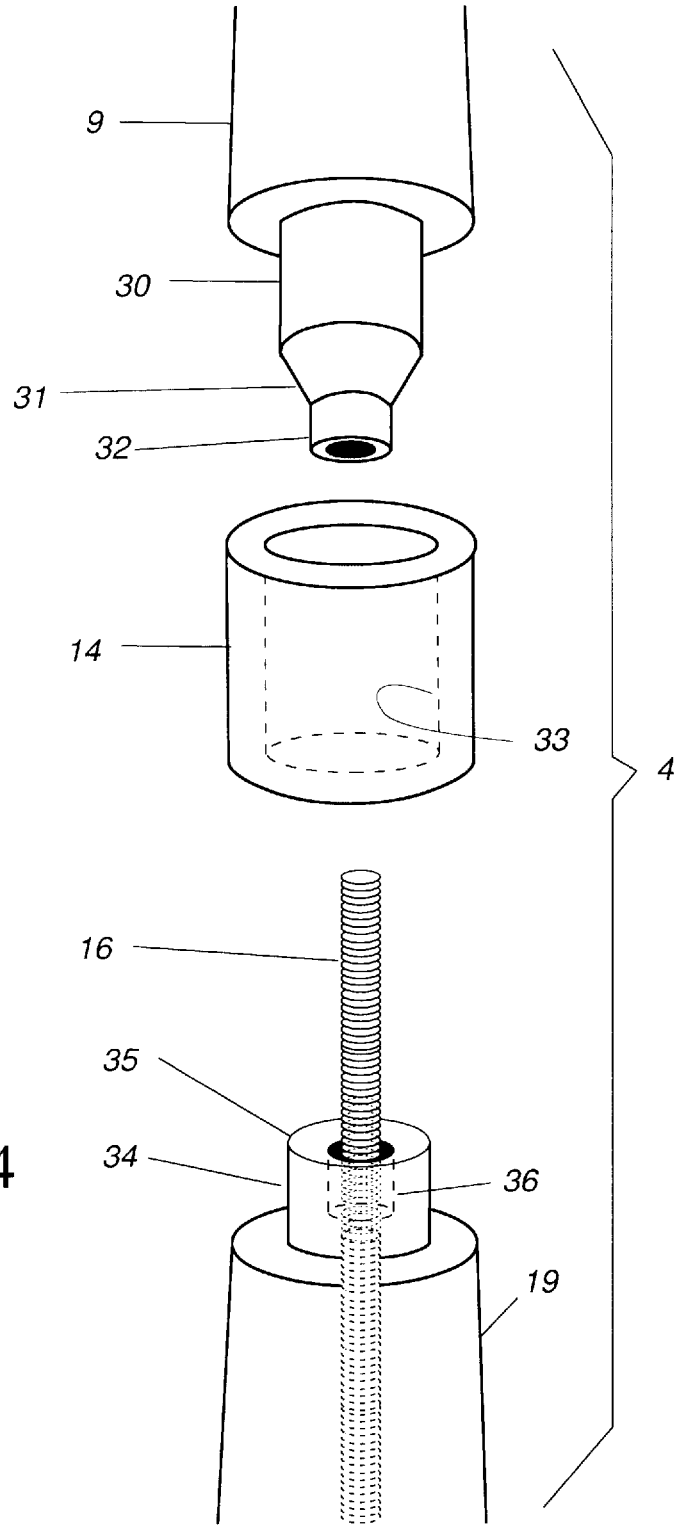
FIG. 4 is a break-away perspective drawing of an A joint 4 as shown in FIG. 1.

FIG. 4 is a break-away perspective drawing of the A joint 4 as shown in FIG. 1. The A joint 4 is designed to provide more centralized weighting and balancing of cue sticks, and the proper balance can be achieved by sizing/positioning/adjusting the threaded internal screw 16 at the manufacturer. The A joint 4 includes a single-ring A joint collar 14 formed with a cylindrical interior of substantially uniform diameter 33. Butt 19 extends upwardly to a reduced diameter butt tenon 34. The outer diameter of butt tenon 34 corresponds to the interior diameter of A joint collar 14, and A joint collar 14 is adapted for slidable insertion onto butt tenon 34. Upon full insertion, the butt tenon 34 should extend upwardly approximately midway through the inside of A joint collar 14. The butt tenon 34 is provided with a concave (e.g., conical) receptacle 35 at its tip leading to a pre-drilled central hole 36 extending axially through butt tenon 34 and into butt 19 for insertion of threaded internal screw 16. The diameter of pre-drilled central hole 36 along the extent of the butt tenon 34 is slightly larger than the diameter of threaded screw 16 to provide a clearance thereabout. Beneath the butt tenon 19, the diameter of pre-drilled central hole 36 conforms to the threaded internal screw 16 for anchoring it in butt 19. Threaded internal screw 16 is screwed downwardly into the pre-drilled hole 36 and axially into butt 19. When securely anchored in butt 19, the threaded internal screw 16 should extend upwardly through the clearance 36 of butt tenon 34 and past the A joint collar 14 for screw-insertion in forearm 9. The lower end of forearm 9 is provided with a downwardly protruding forearm tenon having a pre-drilled (internally-threaded) through-bore for anchoring threaded internal screw 16. The forearm tenon begins with a cylindrical base 30 protruding to a constricted (e.g., conical) section 31, in turn leading to a cylindrical tip 32 of reduced diameter relative to the cylindrical base 30. The cylindrical base 30 is sized for slidable insertion through A joint collar 14. The conical surface of constricted section 31 is adapted for seating within the concave receptacle 35 at the tip of butt tenon 34, and the smaller cylindrical tip 32 of the forearm tenon is sized for insertion into the clearance 36 around threaded internal screw 16.

For assembly, the A joint collar 14 is inserted over the butt tenon 34 and is captured thereon. The lower end of forearm 9 is then inserted such that the threaded internal screw 16 enters the pre-drilled (internally-threaded) through-bore in forearm 9. Forearm 9 is then rotated with respect to butt 19 for screw-insertion of the threaded internal screw 16 into the forearm tenon. Screw-insertion continues until the cylindrical tip 32 of reduced diameter enters and is captured in the clearance 36 maintained around threaded internal screw 16 (along the length of the butt tenon 34). The constricted section 31 of the forearm tenon becomes seated and compressed against the concave receptacle 35 in butt tenon 34.

Figure 5:
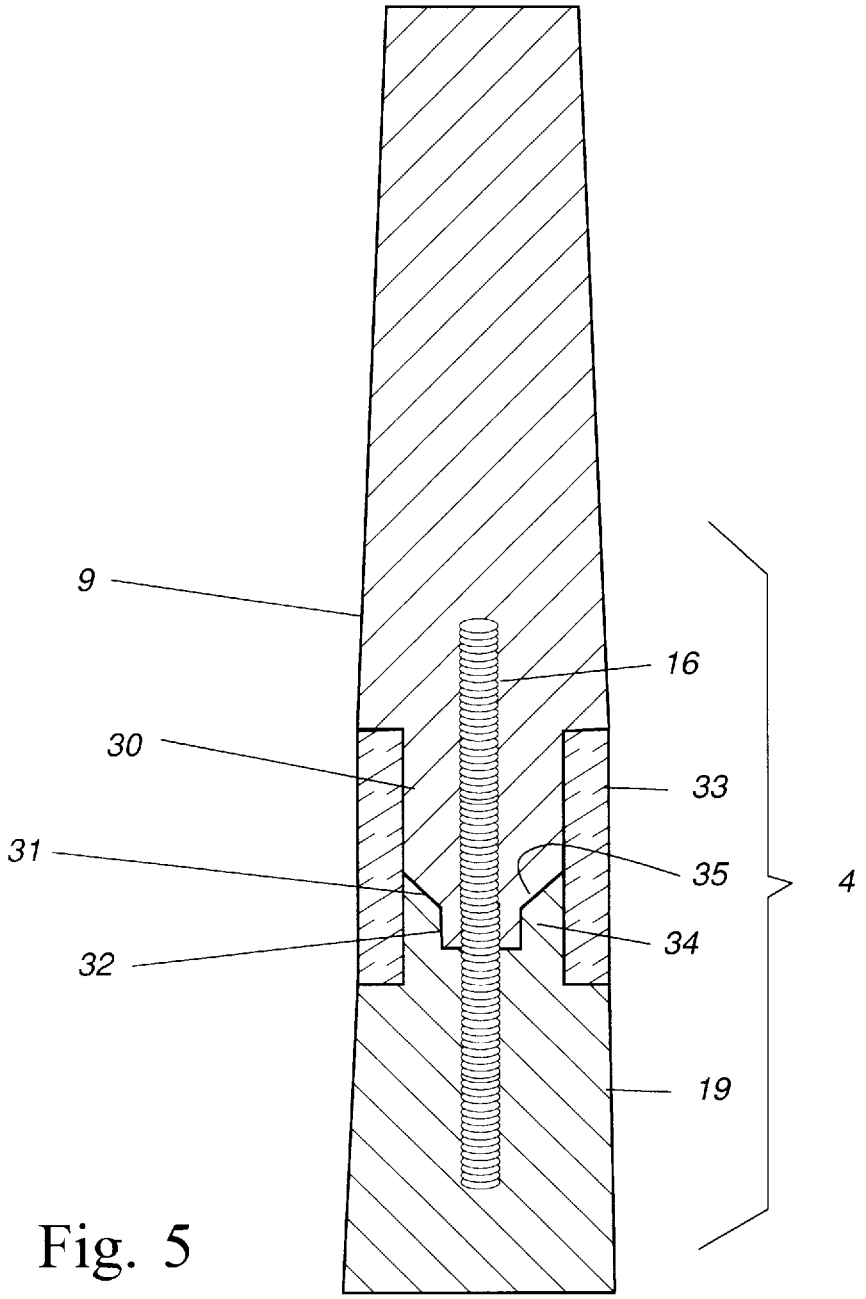
FIG. 5 is a front sectional drawing of the A joint 4 as shown in FIGS. 1 and 4.

FIG. 5 is a front sectional drawing of the fully assembled A joint 4 as shown in FIGS. 1 and 4. As the A joint 4 is tightened in the above-described manner, the downward pressure of the constricted (conical) surface 31 of the forearm tenon against the concave tip 35 of butt tenon 34 serves to perfectly align the forearm 9 with butt 19. Likewise, the pressure causes an expansion within the confines of the A joint collar 14 to provide a secure compression fitting. The A joint 4 provides a level of optimum stability to ensure the consistent hit and feel of the cue regardless of where or how hard the cue ball is struck. Even if the cue ball is struck off center, there is less deflection of the cue at the joint, and resonance is dampened. This gives the feel of a solid one-piece cue stick and increases the accuracy and life expectancy thereof. As with the improved main joint, the advanced player gains the precise "feel" of an integrally formed, single-piece cue, and this increases the level of control.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

I claim:

1. A joint for a billiard cue stick having at least two detachable sections, comprising:

a first tenon extending from a mating end of one of said sections, the first tenon being formed with a constricted area along its length and an axial bore-hole leading inward from a tip thereof;

a second tenon extending from a mating end of the other of said sections, the second tenon being formed with a recessed tip for seating the constricted area of said first tenon, and said second tenon having an axial bore-hole leading inward from the tip thereof;

a threaded screw anchored in one of said sections and extending coaxially outward through the bore hole of the respective tenon for screw insertion in the axial bore-hole in the mating tenon of the other of said sections;

a collar for encircling the mating tenons of said two sections and confining said tenons when said sections are fully screwed together and the screw force causes the mating tenons to expand;

whereby the mating tenons increase the structural integrity of the joint and reduce deflection and resonance when the billiard cue strikes a cue ball.

2. The joint for a billiard cue stick according to claim 1, wherein said first tenon is substantially cylindrical with a constricted mid-section leading to a cylindrical tip.

3. The joint for a billiard cue stick according to claim 2, wherein the recessed tip of the second tenon is formed with a concave recess for seating the constricted area of said first tenon.

4. The joint for a billiard cue stick according to claim 3, wherein the constricted mid-section of said first tenon has a convex conical surface area.

5. The joint for a billiard cue stick according to claim 4, wherein the concave receptacle of said second tenon has a concave conical surface area.

6. The joint for a billiard cue stick according to claim 1, wherein said collar comprises a cylindrical ring.

7. The joint for a billiard cue stick according to claim 6, wherein said collar comprises a cylindrical ring having a uniform cylindrical interior.

8. The joint for a billiard cue stick according to claim 1, wherein said collar comprises a first cylindrical ring and a mating second cylindrical ring.

9. The joint for a billiard cue stick according to claim 8, wherein said first cylindrical ring has a partially uniform cylindrical interior with an enlarged concave receptacle at one end, and said second cylindrical ring has a partially uniform cylindrical periphery leading to a convex tip for mating with the enlarged concave receptacle of said first cylindrical ring.

10. The joint for a billiard cue stick according to claim 9, wherein the enlarged concave receptacle at one end of said first cylindrical ring defines a concave conical surface area, and the convex tip of the second cylindrical ring defines a convex conical surface area for mating with the first cylindrical ring.

11. A main joint for a billiard cue stick having at least two detachable sections, comprising:

a first cylindrical tenon extending from a mating end of one of said sections, said first tenon being formed with a convex area;

a second cylindrical tenon extending from a mating end of the other of said sections, said second tenon being formed with a recessed receptacle adapted for seating the convex area of said first tenon;

a threaded screw anchored in one of said sections and extending axially, centrally and outwardly through the respective tenon for screw insertion into the mating tenon of the other of said sections;

a dual-ring collar for encircling the mating tenons of said two sections, said collar including a first cylindrical ring defined by an interior cylindrical channel leading to an enlarged concave opening at one end, and a second cylindrical ring having a convex brim at one end for mating with the concave opening of said first cylindrical ring;

whereby said convex brim of the second cylindrical ring becomes seated in the enlarged concave opening of the first cylindrical ring for a self-aligning fit, and the dual-rings of said collar encircle and confine said tenons when said sections are fully screwed together and the screw force causes the mating tenons to expand.

12. The main joint for a billiard cue stick according to claim 11, wherein said first tenon is substantially cylindrical with a constricted mid-section leading to a cylindrical tip.

13. The main joint for a billiard cue stick according to claim 12, wherein said first tenon is formed with a first cylindrical section leading to a convex conical mid-section, in turn leading to a second cylindrical section of reduced diameter relative to said first cylindrical section.

14. A billiard cue stick, comprising:

a first section having a first tenon extending from one end, said first tenon being formed with a convex area;

a second section having a second tenon extending from one end, said second tenon being formed with a concave receptacle adapted for receiving the convex area of said first tenon;

a threaded screw anchored in one of said sections and extending outwardly through the respective tenon for screw insertion into the mating tenon of the other of said sections;

a collar for encircling the mating tenons of said first and second sections;

whereby said convex area of the first tenon becomes seated in the concave receptacle of the second tenon for a self-aligning fit of said first and second sections, and said collar encircles and confines said tenons when said sections are fully screwed together and the screw force causes the mating tenons to expand.

15. The billiard cue stick according to claim 14, wherein said collar comprises a cylindrical ring.

16. The billiard cue stick according to claim 15, wherein said collar comprises a cylindrical ring having a uniform axial cylindrical channel.

17. The billiard cue stick according to claim 14, wherein said collar comprises a first cylindrical ring and a mating second cylindrical ring.

18. The billiard cue stick according to claim 17, wherein said first cylindrical ring has an axial and partially uniform cylindrical channel leading to an enlarged concave opening, and said second cylindrical ring has an axial and partially uniform cylindrical periphery leading to a convex tip for mating with the enlarged concave opening of said first cylindrical ring.

19. The billiard cue stick according to claim 14, wherein said first section is a shaft section and said second section is a forearm section.

20. A dual-ring collar for encircling a joint of a billiard cue stick, said dual-ring collar including a first cylindrical ring defined by an axial and partially uniform cylindrical channel leading to an enlarged concave opening, and a second cylindrical ring having an axial and partially uniform cylindrical periphery leading to a convex tip for mating with the concave opening of said first cylindrical ring.

* * * * *